US008893765B2

(12) United States Patent
Leist et al.

(10) Patent No.: US 8,893,765 B2
(45) Date of Patent: Nov. 25, 2014

(54) SYSTEM FOR UNEVENLY WEIGHTED SECTIONAL DOORS

(71) Applicant: Clopay Building Products Company, Inc., Mason, OH (US)

(72) Inventors: Alan R. Leist, Cincinnati, OH (US); Jeffrey W. Stone, Lebanon, OH (US)

(73) Assignee: Clopay Building Products Company, Inc., Mason, OH (US)

( * ) Notice: Subject to any disclaimer, the term of this patent is extended or adjusted under 35 U.S.C. 154(b) by 139 days.

(21) Appl. No.: 13/655,513

(22) Filed: Oct. 19, 2012

(65) Prior Publication Data

US 2014/0110067 A1 Apr. 24, 2014

(51) Int. Cl.
*E05D 15/16* (2006.01)

(52) U.S. Cl.
USPC ..... 160/201; 160/189; 160/191

(58) Field of Classification Search
CPC . E05D 13/1215; E05D 13/1238; E05D 13/07; E05D 15/242; E05Y 2900/106
USPC ..... 160/189, 191, 192, 201
See application file for complete search history.

(56) References Cited

U.S. PATENT DOCUMENTS

| | | | | |
|---|---|---|---|---|
| 1,621,669 | A * | 3/1927 | Johnson | 160/191 |
| 1,994,142 | A | 3/1935 | Madsen | |
| 2,039,296 | A | 5/1936 | Collins | |
| 2,257,484 | A | 9/1941 | Rowe | |
| 3,165,143 | A * | 1/1965 | Jackwig | 160/189 |
| 4,878,529 | A | 11/1989 | Hormann | |
| 4,882,806 | A | 11/1989 | Davis | |
| 5,201,897 | A | 4/1993 | Whiting | |
| 5,419,010 | A | 5/1995 | Mullet | |
| 5,865,235 | A | 2/1999 | Krupke et al. | |
| 5,964,268 | A | 10/1999 | Carper et al. | |
| 6,134,835 | A | 10/2000 | Krupke et al. | |
| 6,986,378 | B2 | 1/2006 | Beaudoin et al. | |
| RE39,504 | E | 3/2007 | Scates et al. | |
| 7,234,502 | B2 | 6/2007 | O'Malley | |
| 7,254,868 | B2 | 8/2007 | Mullet et al. | |
| 7,296,607 | B2 | 11/2007 | Krupke et al. | |
| 7,325,584 | B2 | 2/2008 | Bousson | |
| 7,343,958 | B1 | 3/2008 | East et al. | |
| 7,428,918 | B2 | 9/2008 | Martin | |
| 7,686,061 | B2 | 3/2010 | Mullet et al. | |
| 7,784,521 | B2 | 8/2010 | Mullet et al. | |
| 7,967,051 | B2 | 6/2011 | Diaz | |
| 8,162,026 | B1 | 4/2012 | Lundahl | |
| 2011/0220304 | A1 | 9/2011 | Diaz | |
| 2013/0048232 | A1 | 2/2013 | Friesen et al. | |
| 2014/0110067 | A1 * | 4/2014 | Leist et al. | 160/191 |

* cited by examiner

*Primary Examiner* — Blair M Johnson
(74) *Attorney, Agent, or Firm* — Wood, Herron & Evans, LLP

(57) ABSTRACT

A sectional garage door has a roller track and a plurality of sections pivotally coupled together for movement along the roller track to and between open and closed positions relative to a door opening. A first one of the sections is heavier than other sections. The sectional garage also includes a counterbalance mechanism coupled to the sections to assist an operator in moving the sections along the roller tracks to and between the open and closed positions. The sectional garage door also has a weight assist mechanism coupled to the door and engaged with at least one of the sections to assist at least one of the sections to assist in the movement of the first one of the sections during movement along at least a portion of the roller track due to the weight of the first section relative to the other sections.

21 Claims, 10 Drawing Sheets

SYSTEM FOR UNEVENLY WEIGHTED SECTIONAL DOORS

BACKGROUND OF THE INVENTION

This invention relates generally to a sectional garage door, and more specifically, to a solution for assisting movement of uneven section weight distribution in garage doors between open and closed positions.

Garage doors are typically made up of several sections that are attached together by hinges. A problem in the garage door industry is uneven section weight distribution, which typically occurs when one section in a garage door is much heavier than other sections. Uneven weight distribution may be caused, for example, by the addition of windows, extra strutting, etc., in some of the section and may create balancing challenges to a garage door as the heavy section transitions from its vertical orientation to horizontal or vice versa as the door opens and closes.

Historically, upward acting sectional doors have been provided with counterbalance mechanisms comprising, typically, a torsion coil spring or extension spring operably engaged with the door. These mechanisms, however, do not adequately account for the movement of dissimilarly weighted sections of the door.

U.S. Patent Application Publication No. 2011/0220304 to Diaz teaches a counterbalance system which attempts to address this problem and discloses an elongated shaft supported for rotation between support brackets located above the door opening. Torsion coil counterbalance springs are sleeved over the shaft, and at least one cylindrical tubular sleeve is disposed over the shaft and within each of the springs. When the springs are wound to provide for exerting a torque on the shaft, the inside diameters of the coils are reduced and a number of coils become forcibly engaged with the sleeve, while other coils remain free to contract or expand. In this manner, the effective torque or force exerted by the spring is modified from that of a conventional torsion coil spring. However, the system according to the Diaz publication would require complete replacement of the counterbalance system to retrofit an existing door installation in an attempt to address this problem.

U.S. Pat. No. 8,162,026 to Lundahl also discloses a system to address the problem of unevenly weighted sectional doors including a horizontal rotating shaft mounted above the door opening, and primary and auxiliary torsion springs sleeved over the shaft. The primary torsion spring provides a lifting force for the door throughout its travel path while opening and provides a weight support force for the door throughout its travel path while closing. The auxiliary torsion spring provides a lifting force for the door only during a portion (e.g., during travel of the door over an initial segment, such as approximately the first three feet) of its travel path while opening and provides a weight supporting force for the door only during a portion (e.g., during travel of the door over a final segment, such as the last three feet) of its travel path while closing. Lundahl teaches another modification of a traditional counterbalance torsion spring system and, as such, offers a costly and complex attempt to solve the problem of unevenly weighted sectional doors.

SUMMARY OF THE INVENTION

The invention overcomes the problems associated with prior art systems to remedy this problem by mounting a tension or compression spring on either or both side(s) of the sectional door frame, and adapting the spring to engage with a predetermined section of the garage door as the door opens and closes.

Generally, the invention is applicable to either torsion or extension spring counterbalance systems and involves mounting an additional extension or compression spring to each side edge of the door near the track. The added springs are only engaged when the heavy section(s) of the door are travelling over a specific section of the track system (i.e., the curved portion of the track and adjacent track portions). The traditional counterbalance torsion/extension spring system is not altered or modified with the invention. Moreover, a system according to this invention can be added to an existing door installation as a retrofit solution to the problem.

One embodiment of this invention offers these and other advantages over known overhead sectional doors having at least one section that is heavier than the other sections. The sectional door according to this invention includes a roller track and a plurality of sections pivotally coupled together for movement along the roller track to and between open and closed positions relative to a door opening. A first one of the sections is heavier than other sections of the door. The door includes a traditional counterbalance mechanism coupled to the sections to assist an operator in moving the sections along the roller tracks to and between the open and closed positions. The door further includes a weight assist mechanism coupled to the door and engaged with at the least one of the sections to assist in the movement along at least a portion of the roller track due to the weight of the first section relative to the other sections.

In one embodiment, the weight assist mechanism further includes a roller assembly having an activation pin and a roller wheel movably situated on the roller track and coupled to at least one of the sections. Movement of the roller wheel along the roller track guides the movement of the sectional door to and between the open and closed positions. The weight assist mechanism also includes a trolley assembly and a spring assembly coupled to the trolley assembly. When the garage door moves between the open and closed positions, the trolley assembly moves along the roller track and activates the spring assembly, thereby providing assistance to the door when moving to and between open and closed positions. The spring assembly may include a force adjustment screw and a spring. In one embodiment, the weight assist spring is a tension spring. In another embodiment, the weight assist spring is a compression spring.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
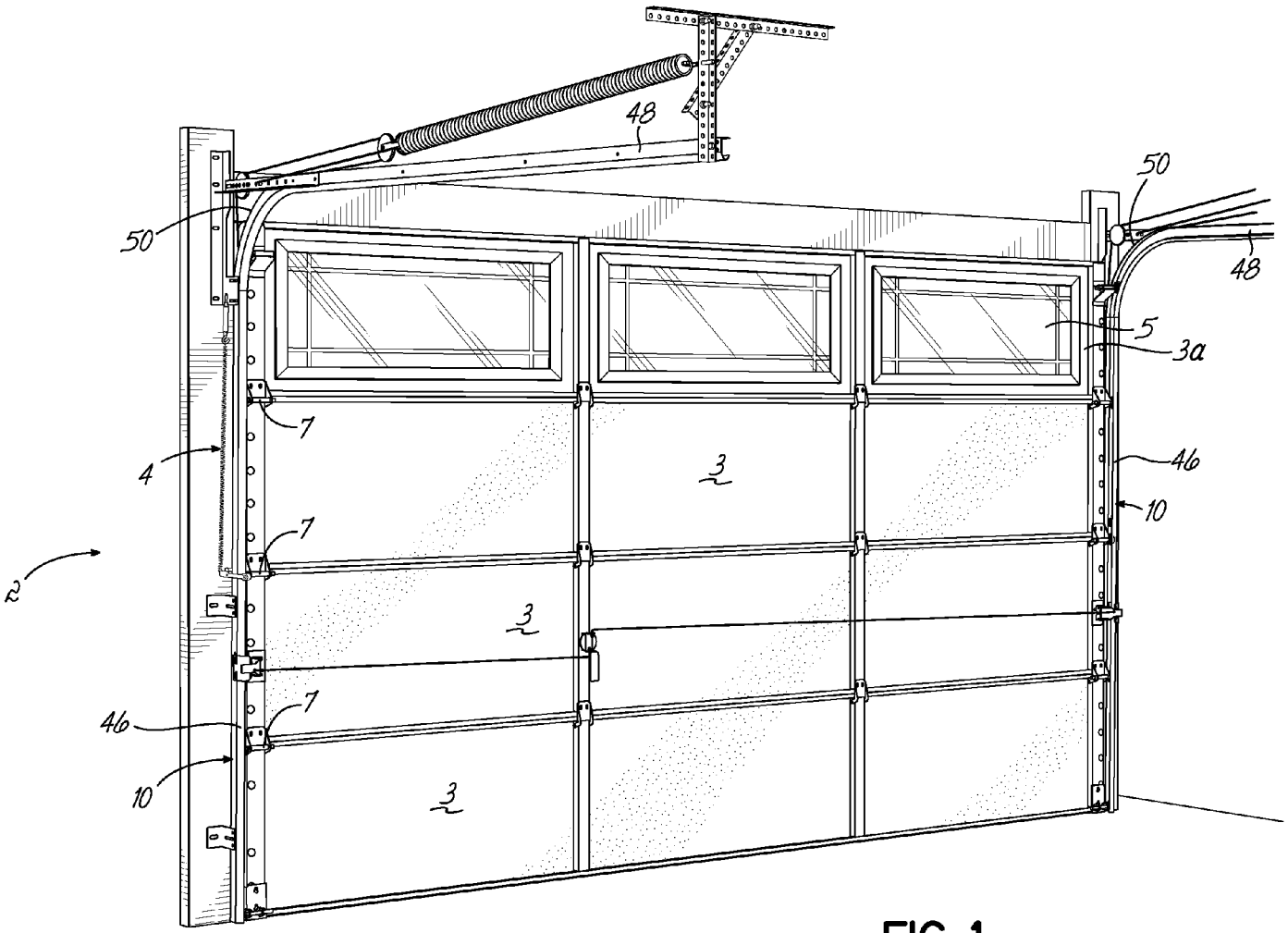
FIG. 1 is a perspective view of an exemplary sectional door in a closed position.

Referring to FIG. 1, one embodiment of a sectional door 2 according to this invention is shown in a closed generally vertical configuration covering an opening in a wall (not shown) of a garage, warehouse, or the like. The door 2 includes a plurality of sections 3. In one embodiment, as shown in FIG. 1, at least one of the sections 3 includes one or more windows 5. The adjacent sections 3 are pivotally connected together by a number of hinges 7. The hinges 7 proximate the lateral side ends of each section 3 include a roller assembly for coupling the door 2 to a roller track 10 (FIG. 1). The roller assemblies are mounted on the sections 3 and coupled to the roller track 10 to guide the door 2 between the closed and open configurations. The roller track 10 includes at least one vertical section 46, each of which are mounted to the wall on opposite sides of the opening. The vertical sections 46 are each connected to a horizontal section 48 through a curved transition section 50 as is readily known by one skilled in the art. Each track section 46, 48, 50 has a generally J-shaped or C-shaped cross-sectional configuration (see FIG. 12) into which each of the roller wheels 17 of the roller assemblies is captured to assist in and guide the movement and articulation of the door 2 to and between the closed and open configuration as the rollers translate along the vertical, transition and horizontal sections 46, 48, 50 of the roller track 10.

Figure 2:
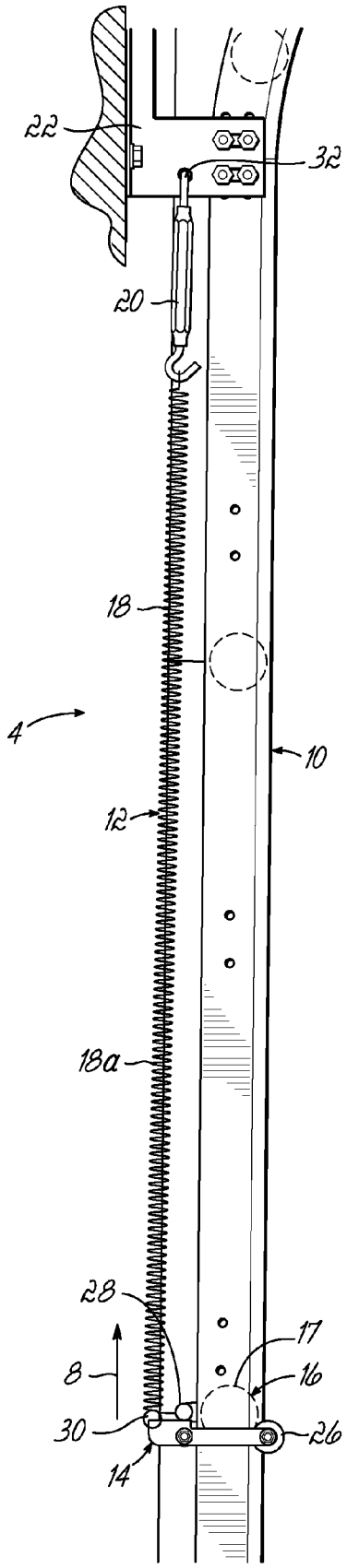
FIG. 2 is a front view of a weight assist mechanism in a extended position according to an embodiment of this invention.

FIG. 2 shows an exemplary embodiment of the door 2 in a closed position including a weight assist mechanism 4 according to one embodiment of this invention. The weight assist mechanism 4 may include a spring assembly 12 which further includes a spring 18 and a force adjustment screw 20. The spring 18 is coupled with a trolley assembly 14 at a first end 30 of the weight assist mechanism 4. The force adjustment screw 20 is connected to a flag bracket 22 mounted to a header at a second end of the weight assist mechanism 4 and coupled to the spring 18. Other mounting schemes and members can be used within the scope of this invention in addition to or as a substitute for the flag bracket 22. The roller assembly 16 includes a roller wheel 17 and an activation pin 28. When the door 2 is moving to and between the closed and the open positions, roller assembly 16 travels along roller track 10. The upward movement of roller assembly 16 allows spring 18 to move from an extended position 18*a* into a compressed position 18*b* (FIG. 3) in the direction of arrow 8. Due to the coupling between spring 18 and trolley assembly 14, the movement of spring 18 from a extended position into a compressed position provides an upward acting force on the trolley assembly 14. A contact surface 36 of trolley assembly 14 thereby engages activation pin 28 of roller assembly 16 and assists in the upward movement of roller assembly 16 and the door 2. The weight assist mechanism 4 may be installed in conjunction with installation of a new sectional garage door 2 or may be installed or retrofitted on an existing sectional garage door 2.

Figure 3:
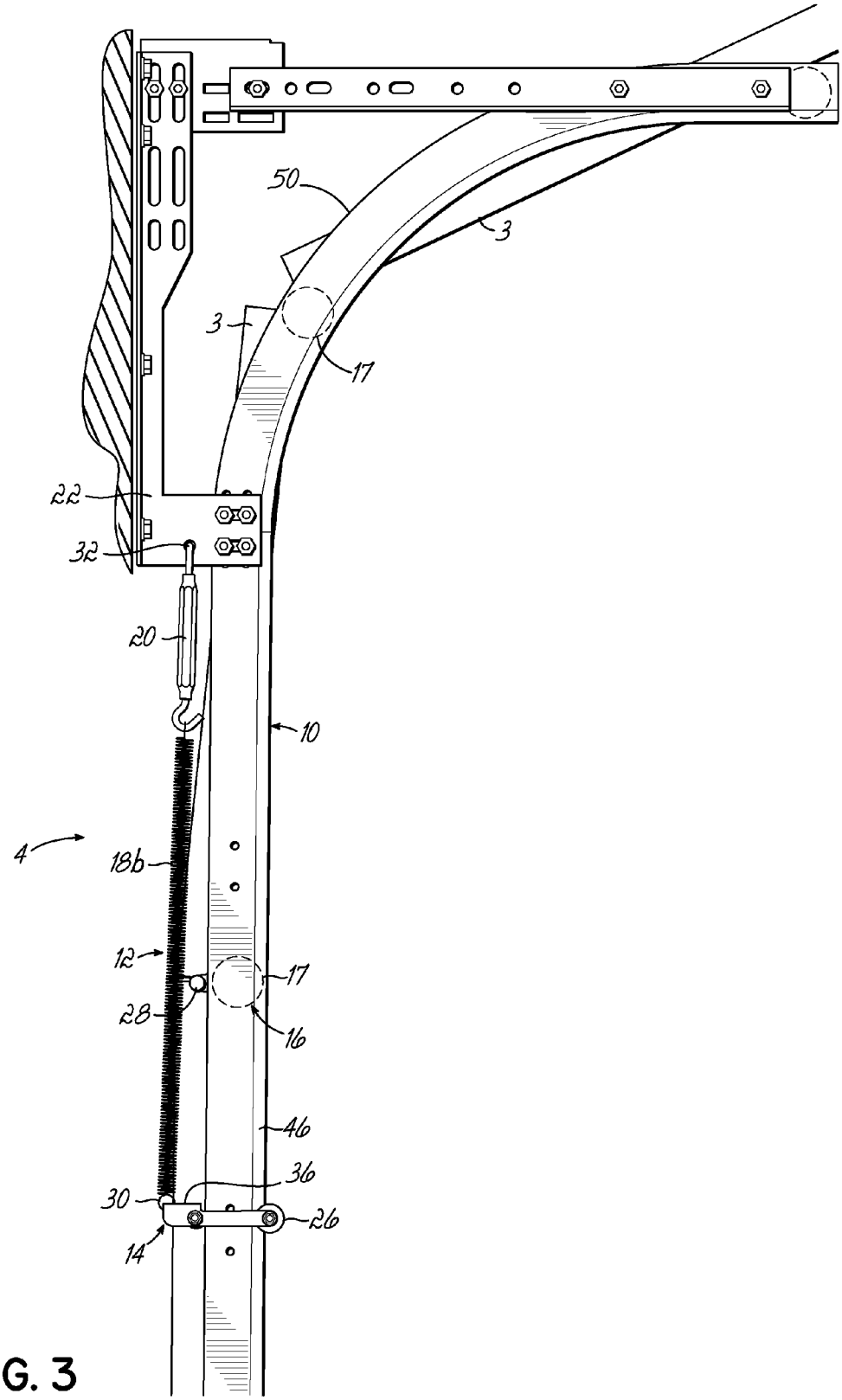
FIG. 3 is a front view of the weight assist mechanism of FIG. 2 in a released position.

In FIG. 3, door 2 is shown in the process of moving from a closed position to an open position. In this transition period, spring 18 moves from an extended position 18*a* to a compressed position 18*b*. Roller assembly 16 is travelling along the roller track 10 and as shown, is still in the vertical section 46 of roller track 10. Trolley assembly 14, due to the movement of spring 18 from an extended position 18*a* (FIG. 2) to a compressed position 18*b* (FIG. 3) has traveled along the roller track 10 due to the coupling of guide wheel 26 to roller track 10. Sections 3 have also moved along the roller track 10 in conjunction with the movement of the roller assembly 16 along the roller track 10. The contact surface 36 of trolley assembly 14 is no longer engaged with activation pin 28 of the roller assembly 16 once the roller assembly 16 and door 2 have traveled beyond a disengagement point along the roller track 10. The selective engagement of roller assembly 16 with trolley assembly 14 allows the spring 18 to assist transition of the door 2 between opening and closing positions, and more specifically, when the heavier section 3*a* is travelling between the vertical and horizontal portions 46 and 48 of roller track 10. The duration of selective engagement depends on the length and displacement of the spring in the extended position and the spring constant of spring 18. The tension force of spring 18 can be adjusted by adjusting force adjustment screw 20.

Figure 4:
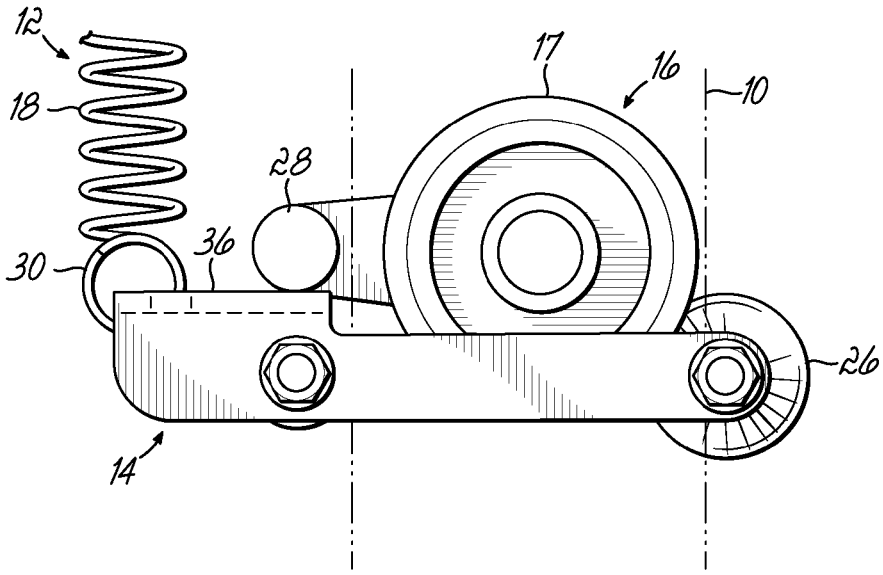
FIG. 4 is a front view of a roller assembly, spring assembly and trolley assembly.
Figure 5:
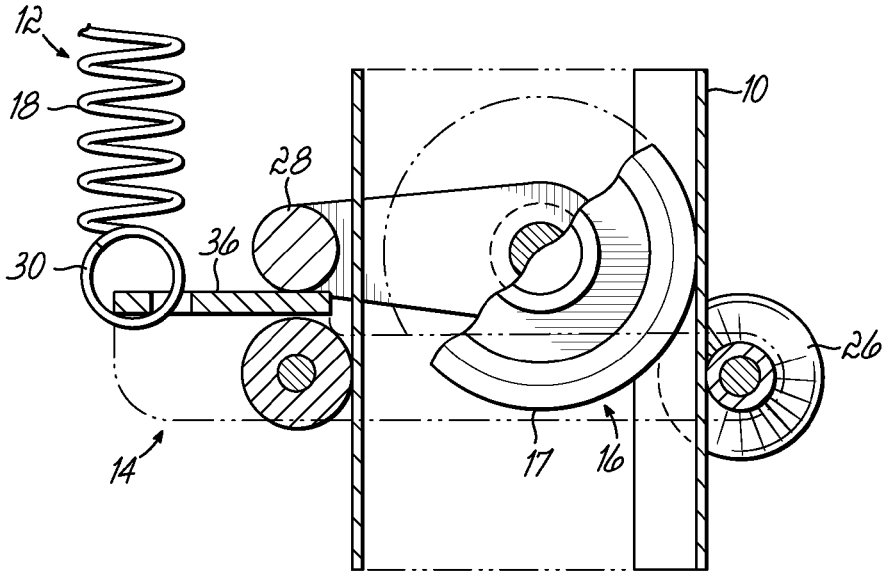
FIG. 5 is a detailed front view of a roller assembly, spring assembly and trolley assembly.

FIGS. 4 and 5 show a detailed view of the trolley assembly 14, roller assembly 16 and the spring assembly 12 of FIGS. 2-3. Spring 18 of spring assembly 12 is coupled to trolley assembly 14 at a first end 30 of the weight assist mechanism 4. Contact surface 36 of trolley assembly 14 engages with the activation pin 28 of roller assembly 16. As seen in more detail in FIG. 5, activation pin 28 is fixably attached to roller wheel 17. Upon the movement of roller wheel 17 along roller track 10, activation pin 28 moves in concert with roller wheel 17 and is engaged with contact surface 36 of roller assembly 14 until a disengagement point is reached, depending on the position, length and displacement of the spring 18 in the extended position 18*a* and the spring constant of spring 18. A guide wheel 26 guides the trolley assembly 14 along the roller track 10 during the movement of the door 2 from a closed position to an open position. The distance and duration of movement of trolley assembly 14 also depends upon the position and characteristics of the spring 18 and spring assembly 12.

Figure 6:
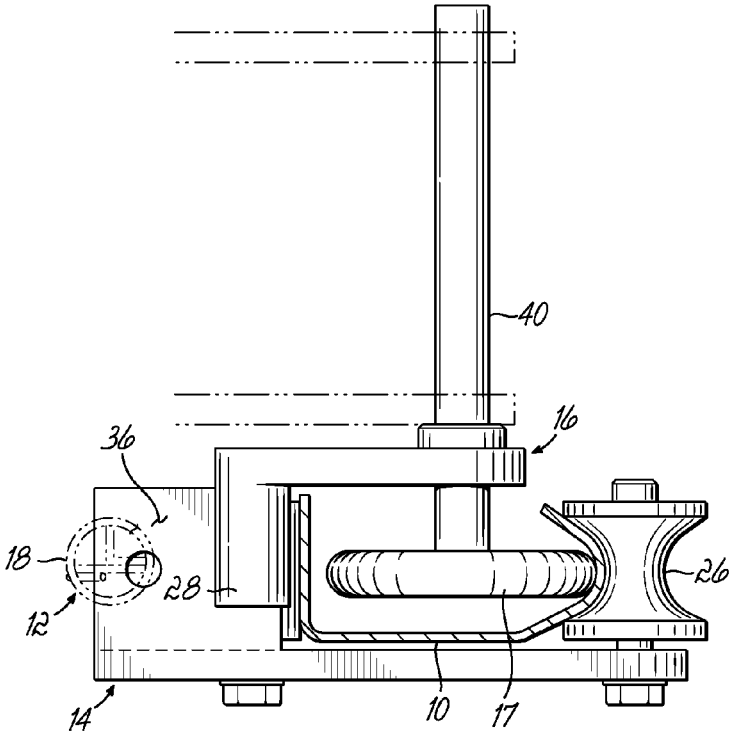
FIG. 6 is a top view of a roller assembly, spring assembly and trolley assembly according to various aspects of this invention.

FIG. 6 shows a detailed top view of roller assembly 16 and trolley assembly 14 according to one embodiment of this invention. The embodiment shown of spring assembly 12 includes a tension spring 18. The roller wheel 17 of roller assembly 16 travels along the roller track 10 when the door 2 moves to and between open and closed positions. Guide wheel 26 enables trolley assembly 14 to move along the roller track 10 when the door 2 is moving to and between open and closed positions.

Figure 7:
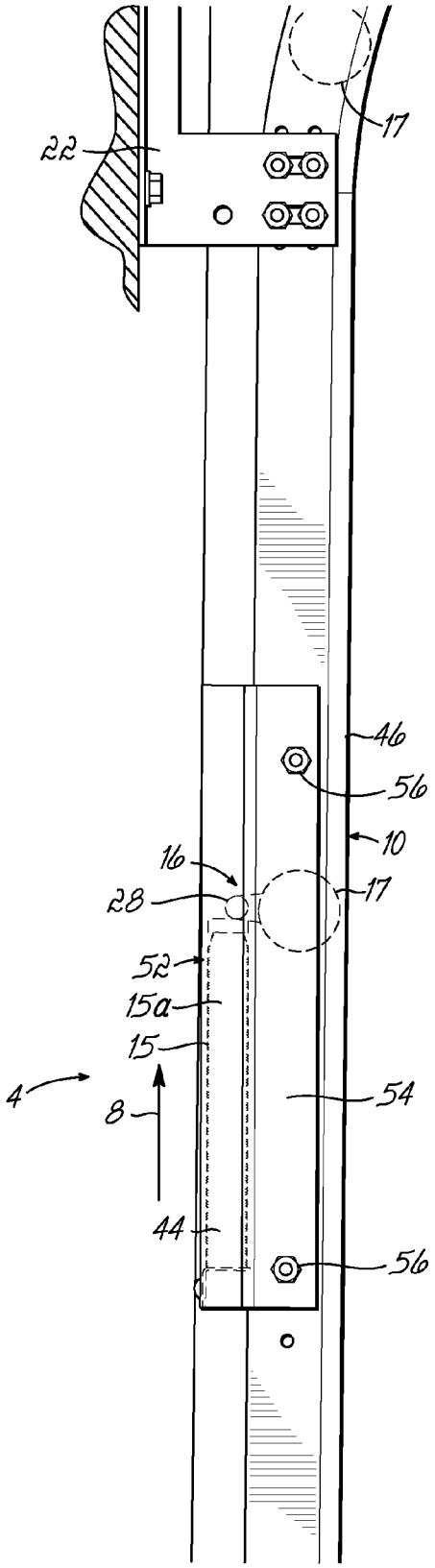
FIG. 7 is a front view of an alternate embodiment of a weight assist mechanism in a compressed position according to this invention.
Figure 8:
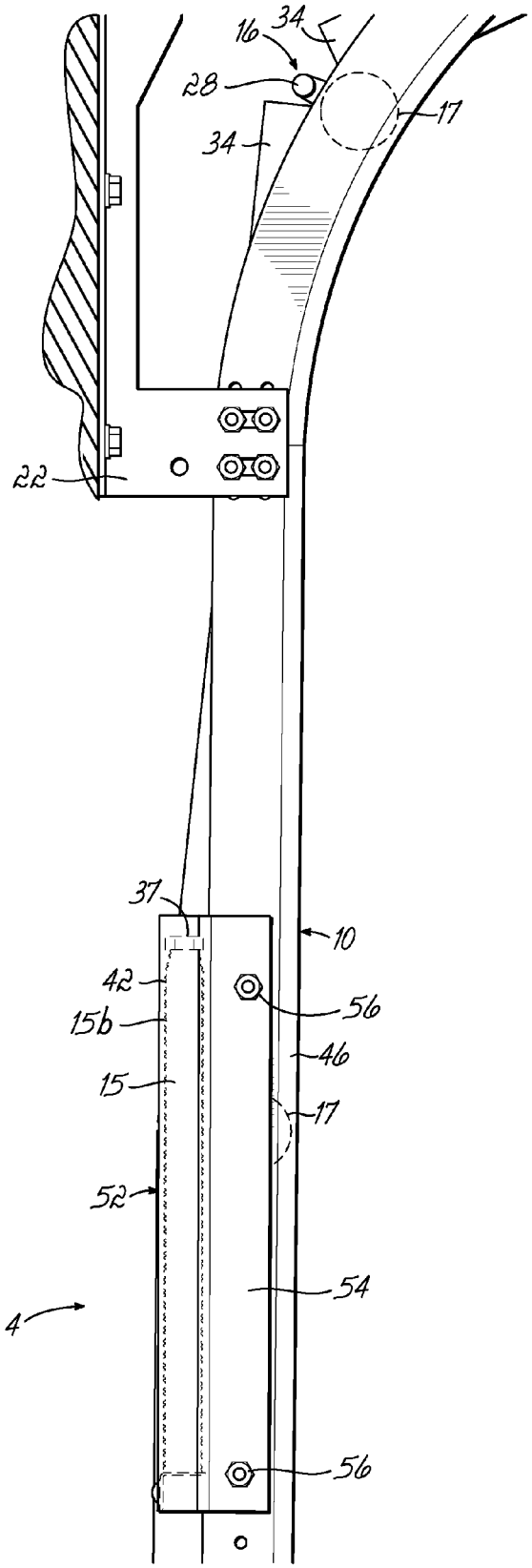
FIG. 8 is a front view of an alternate embodiment of a weight assist mechanism in a compressed position according to this invention.
Figure 9:
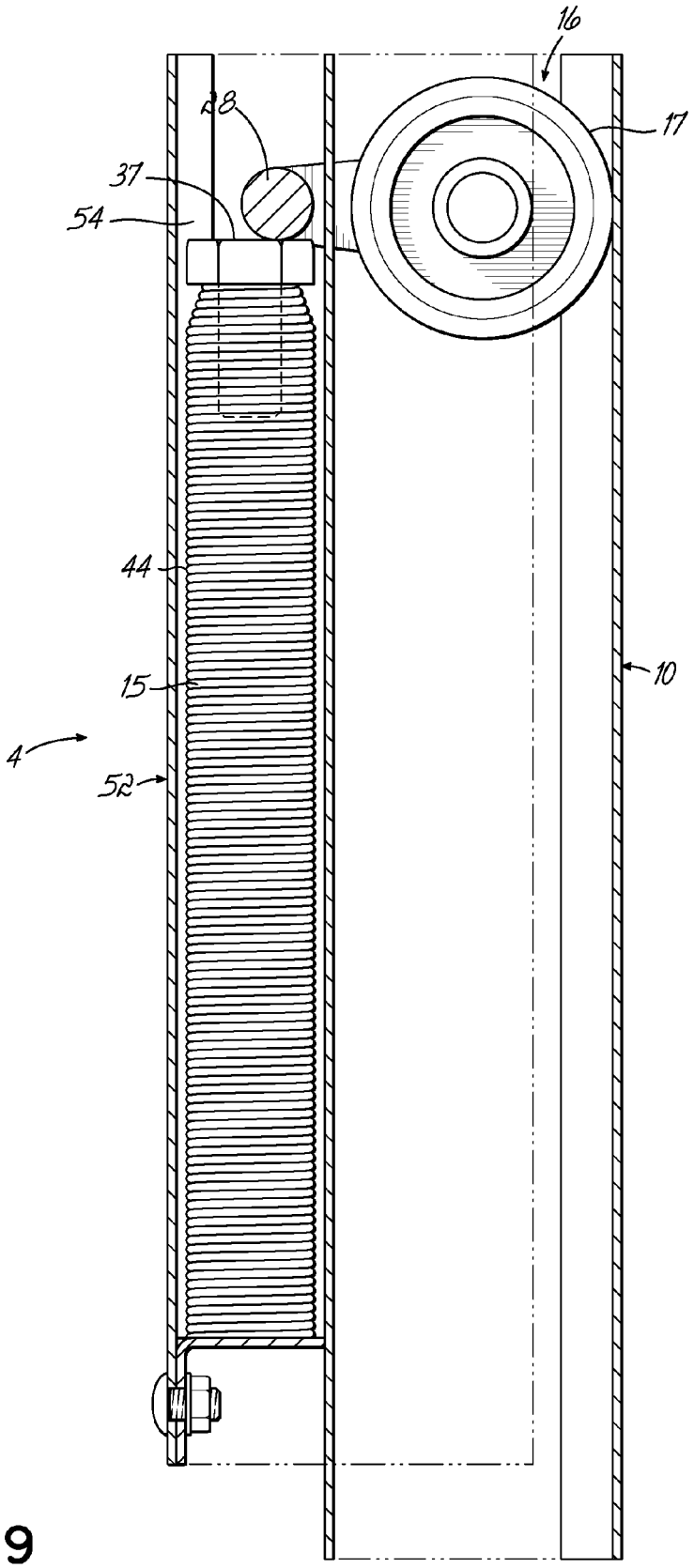
FIG. 9 is a side view of an alternate embodiment of a weight assist mechanism in a compressed position.

FIG. 7 shows an alternative embodiment of a weight assist mechanism 4 for use in a sectional garage door 2. Trolley assembly 52 includes a compression spring 15 (shown hidden in phantom in FIG. 7) and a housing 54 coupled to the roller track 10 by a plurality of bolts 56. The housing 54 contains the compression spring 15. The spring 15 is in a compressed state 15*a* when the garage door 2 is in a closed position. Upon the movement of roller assembly 16 along roller track 10, spring 15 is released and moves from a compressed state 15*a* to a released state 15*b* (FIG. 8). During the movement of spring 15 from compressed state 15*a* to released state 15*b*, it assists the movement of roller assembly 16 along the roller track when the contact surface 37 engages the activation pin 28 (FIGS. 8 and 9). The assistance is selective in that the weight assist mechanism 4 is only engaged during a portion of the door's travel and occurs while the heavier section 3*a* is moving from the vertical portion of the track 46 to the horizontal section 48. In the embodiment shown in FIGS. 7 and 8, the trolley assembly 52 remains fixed relative to the roller track 10 during the engagement of the spring 15 and roller assembly 16. FIG. 9 is a detailed, close-up view of the embodiment of the weight assist mechanism from FIGS. 7 and 8 having a compression spring-based mechanism.

Figure 10:
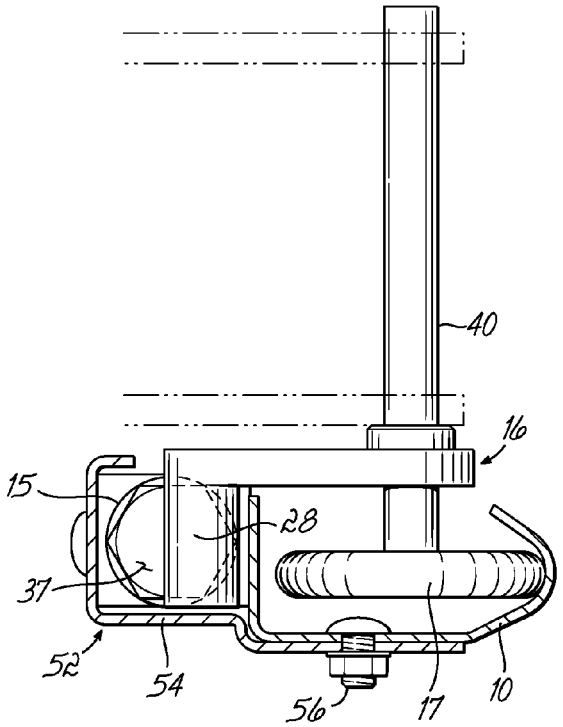
FIG. 10 is a top view of an alternate embodiment of a roller assembly, spring assembly and trolley assembly.

FIG. 10 shows a detailed top view of the roller assembly 16 and trolley assembly 14 of FIG. 7. The embodiment shown of spring assembly 12 includes a compression spring 15. Roller wheel 17 of roller assembly 16 travels along the roller track 10 when the door 2 moves to and between open and closed positions. Guide wheel (not shown) enables trolley assembly 14 to move along the roller track 10 when the door 2 is moving to and between open and closed positions.

Figure 11:
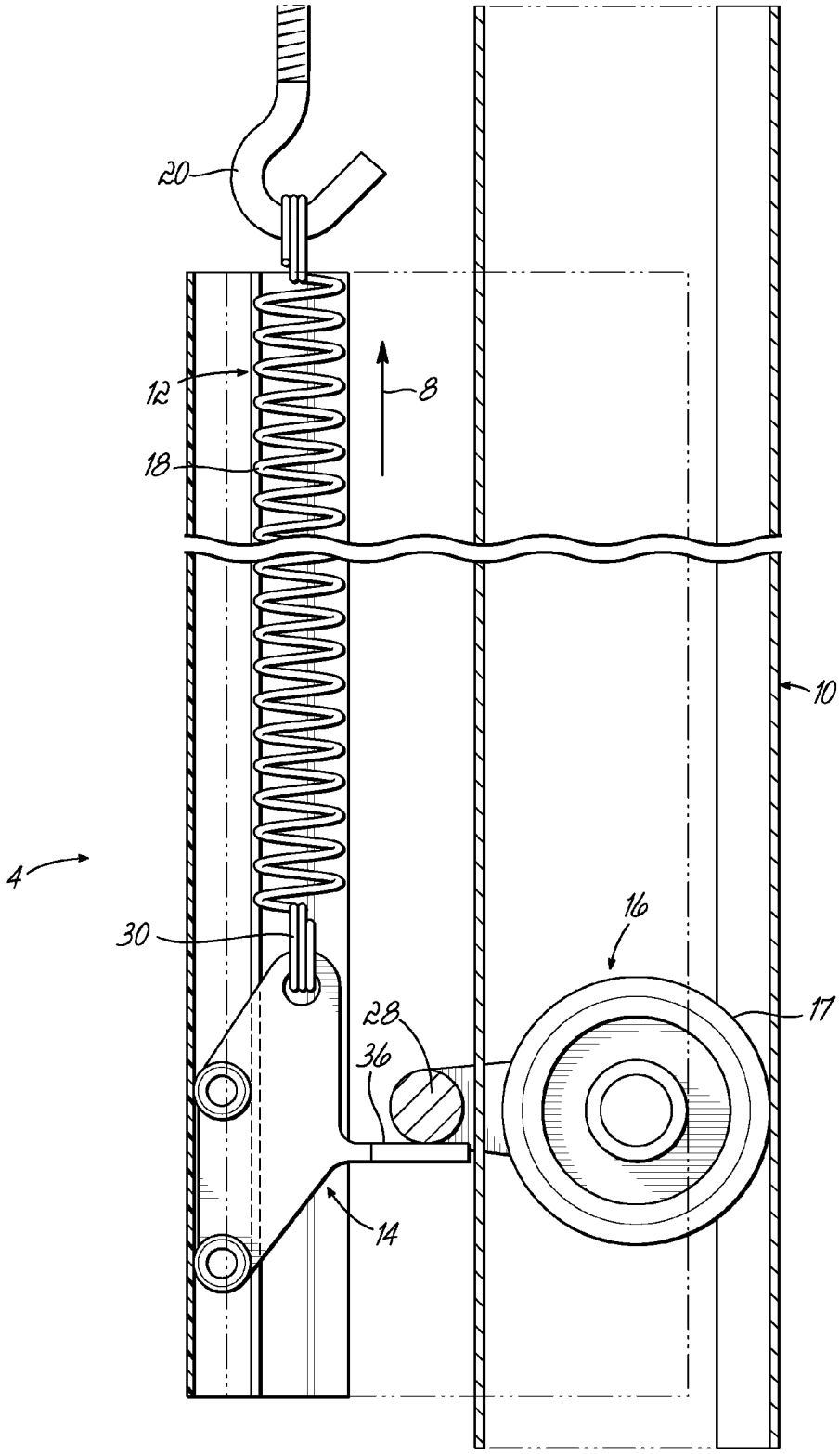
FIG. 11 is a front view of an alternate embodiment of a weight assist mechanism in a extended position.

FIG. 11 is a further alternative embodiment of the weight assist mechanism 4 showing an alternative embodiment of the trolley assembly 14 using a tension Spring 18. In this embodiment, like that of FIGS. 2 and 3, the weight assist mechanism 4 includes a spring assembly 12 which further includes a spring 18 and a force adjustment screw 20. The tension spring 18 is coupled with the trolley assembly 14 at a first end 30 of the weight assist mechanism 4. The force adjustment screw 20 is connected to a header, bracket or other member (not shown in FIG. 11) at a second end of the weight assist mechanism 4 and coupled to the spring 18. Roller assembly 16 includes a roller wheel 17 and an activation pin 28. When the door 2 is moving from the closed to the open position, roller assembly 16 travels along roller track 10. The upward movement of roller assembly 16 allows spring 18 to move from a extended position 18*a* into a compressed position 18*b* in the direction of arrow 8. Due to the coupling between spring 18 and trolley assembly 14, the movement of spring 18 from an extended position into a compressed position provides an upward acting force on the trolley assembly 14 and the door 2. The contact surface 36 of trolley assembly 14 thereby engages activation pin 28 of roller assembly 16 and assists in the upward movement of roller assembly 16 and the door 2.

Figure 12:
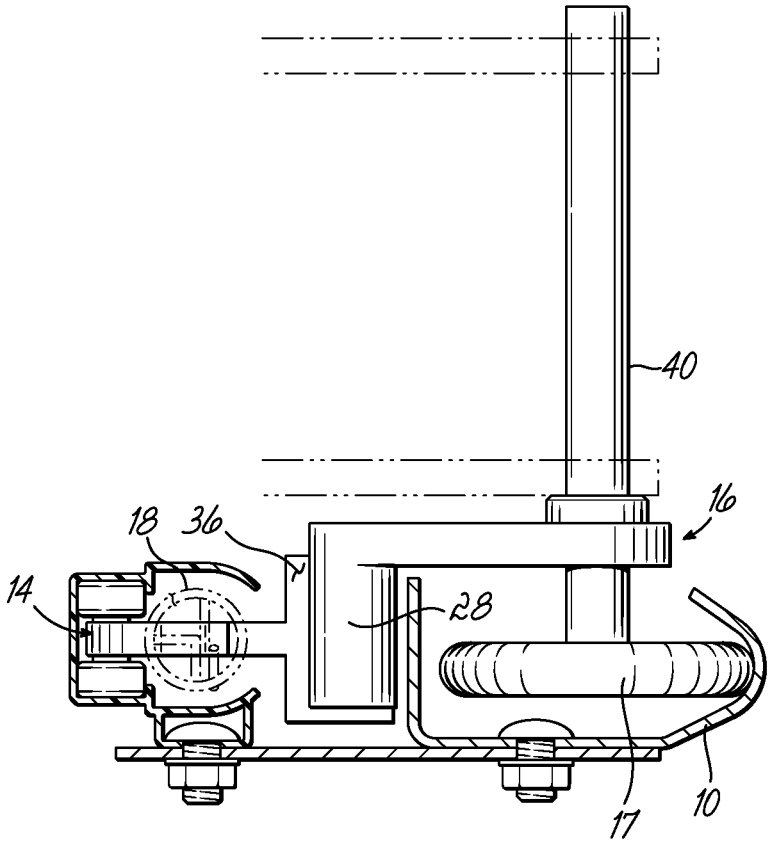
FIG. 12 is a top view of an alternate embodiment of a roller assembly, spring assembly and trolley assembly.

FIG. 12 shows a detailed top view of an alternative embodiment of the roller assembly 16 and trolley assembly 14. The embodiment shows a tension spring 18 coupled to the trolley assembly 14. Roller wheel 17 of roller assembly 16 travels along the roller track 10 when the door (not shown) moves to and between open and closed positions. Upon the movement of roller wheel 17 along roller track 10, activation pin moves in concert with roller wheel and is engaged with contact surface 36 of roller assembly 14 until a certain point, depending on the position, length and displacement of the spring in the extended position and the spring constant of spring 18. A guide wheel 26 guides the trolley assembly 14 along the roller track 10 during the movement of the door from a closed position to an open position. The distance and duration of movement of trolley assembly 14 also depends upon the characteristics of the spring 18. Guide wheel (not shown) enables trolley assembly 14 to move along the roller track 10 when the door (not shown) is moving to and between open and closed positions.

From the above disclosure of the general principles of this invention and the preceding detailed description of at least one embodiment, those skilled in the art will readily comprehend the various modifications to which this invention is susceptible. For example and without limitation, the various embodiments of this invention are shown and described herein coupled to a roller mechanism for the respective door sections, but the invention is not limited to implementation with only roller assisted sectional doors. Therefore, we desire to be limited only by the scope of the following claims and equivalents thereof.

We claim:

1. A sectional door comprising:

a track;

a plurality of sections pivotally coupled together for movement along the track to and between open and closed positions relative to a door opening wherein a first one of the sections is heavier than other sections;

a counterbalance mechanism coupled to the sections to assist an operator in moving the sections along the track to and between the open and closed positions; and a weight assist mechanism coupled to the door and engaged with at least one of the sections to assist the at least one of the sections in the movement along at least a portion of the track due to the weight of the first section relative to the other sections, and selectively disengaged from the at least one section when the door is at least partially open;

wherein the weight assist mechanism is independent of the counterbalance mechanism.

2. The sectional door of claim 1 wherein the first one of the sections further comprises a window.

3. The sectional door of claim 1, wherein the weight assist mechanism is adapted to be adjusted according to the weight of at least one section of the door.

4. The sectional door of claim 1 wherein the weight assist mechanism is selectively engaged during movement of the sectional door.

5. The sectional door of claim 1 wherein the weight assist mechanism is spaced from the counterbalance mechanism.

6. The sectional door of claim 1 wherein the counterbalance mechanism further comprises:

an extension spring.

7. The sectional door of claim 1 wherein the weight assist mechanism is not connected to the counterbalance mechanism.

8. The sectional door of claim 1 wherein the weight assist mechanism is coupled to a generally vertical portion of the track.

9. The sectional door of claim 1 wherein the counterbalance mechanism engages a different one of the plurality of sections from the at least one of the sections to which the weight assist mechanism is engaged.

10. The sectional door of claim 9 wherein the counterbalance mechanism is coupled to a bottom most one of the plurality of sections when the door is in the closed position.

11. The sectional door of claim 1 wherein the weight assist mechanism further comprises a weight assist spring and the counterbalance mechanism further comprises a counterbalance spring which is not collinear with the weight assist spring and the weight assist mechanism assists the movement of the door from the closed position toward the open position.

12. The sectional door of claim 1 wherein the first one of the sections is different from the at least one of the sections.

13. A sectional door comprising:

a track;

a plurality of sections pivotally coupled together for movement along the track to and between open and closed positions relative to a door opening wherein a first one of the sections is heavier than other sections;

a counterbalance mechanism coupled to the sections to assist an operator in moving the sections along the track to and between the open and closed positions;

a weight assist mechanism coupled to the door and engaged with at least one of the sections to assist the at least one of the sections in the movement along at least a portion of the track due to the weight of the first section relative to the other sections;

a roller assembly having an activation pin and a roller wheel movably situated on the track and coupled to at least one of the sections, wherein the movement of the roller wheel along the roller track guides the movement of the sectional door to and between the open and closed positions;

a trolley assembly; and a spring assembly coupled to the trolley assembly;

wherein when the garage door moves between the open and closed positions, the trolley assembly moves along the roller track and activates the spring assembly.

14. The sectional door of claim 13, wherein the spring assembly further comprises a force adjustment mechanism and a spring.

15. The sectional door of claim 14, wherein the force adjustment mechanism is fixably attached at a first end and to the spring at a point between the first end and a second end, and the spring is fixably attached to the trolley assembly at the second end.

16. The sectional door of claim 14, wherein the spring comprises one of a tension spring and a compression spring.

17. The sectional door of claim 13, wherein the spring assembly is adapted to be adjusted according to the weight of at least one section of the door.

18. The sectional door of claim 14 wherein an activation of the spring causes the spring to assist the door to and between the open and closed positions.

19. A sectional door comprising:

a track;

a plurality of sections pivotally coupled together for movement along the track to and between open and closed positions relative to a door opening wherein a first one of the sections is heavier than other sections;

a counterbalance mechanism coupled to the sections to assist an operator in moving the sections along the track to and between the open and closed positions; and a weight assist mechanism coupled to the door and engaged with at least one of the sections to assist the at least one of the sections in the movement along at least a portion of the track due to the weight of the first section relative to the other sections;

wherein the weight assist mechanism is selectively engaged during movement of the sectional door and only engaged while the first one of the sections traverses along a transition portion of the track intermediate a vertical portion and a horizontal portion of the track.

20. A sectional door comprising:

a roller track;

a plurality of sections pivotally coupled together for movement along the roller track to and between open and closed positions relative to a door opening wherein a first one of the sections is heavier than other sections;

a counterbalance mechanism coupled to the sections to assist an operator in moving the sections along the roller tracks to and between the open and closed positions; and a roller assembly having an activation pin and a roller wheel movably situated on the roller track and coupled to at least one of the sections, wherein the movement of the roller wheel along the roller track guides the movement of the sectional door to and between the open and closed positions;

a trolley assembly comprising an activating surface and a guide wheel movable along the roller track; and a spring assembly fixably attached at a first end to the header and at a second end to the trolley assembly;

wherein when the garage door moves between the open and closed positions, the trolley assembly moves along the roller track and activates the spring assembly.

21. The sectional door of claim 20 wherein an activation of the spring causes the spring to assist the door to and between the open and closed positions.

* * * * *